US005479732A

United States Patent [19]

Burtch et al.

[11] Patent Number: 5,479,732

[45] Date of Patent: Jan. 2, 1996

[54] ERECTABLE PERISCOPING DISPLAY DEVICE

[75] Inventors: Ronald P. Burtch, Stouffville; Irving M. Koltz, Toronto, both of Canada

[73] Assignee: Ronald P. Burtch & Associates Limited, Canada

[21] Appl. No.: 263,337

[22] Filed: Jun. 21, 1994

[51] Int. Cl.[6] ..... G09F 1/06

[52] U.S. Cl. ..... 40/124.1; 40/539; 40/610

[58] Field of Search ..... 40/120, 124.1, 40/155, 539, 610

[56] References Cited

U.S. PATENT DOCUMENTS

| | | | |
|---|---|---|---|
| 2,125,424 | 8/1938 | Cloud | 40/539 |
| 2,142,826 | 1/1939 | Rosello . | |
| 2,311,218 | 2/1943 | Fandrich . | |
| 2,449,911 | 9/1948 | Roth . | |
| 2,472,166 | 6/1949 | Mathewson | 40/124.1 |
| 2,530,950 | 11/1950 | Ebert et al. . | |
| 2,720,046 | 10/1955 | Decker . | |
| 2,975,905 | 7/1959 | Foland | 40/124.1 X |
| 3,029,051 | 4/1962 | Nichols . | |
| 3,226,863 | 1/1966 | Southard . | |
| 3,763,583 | 10/1973 | Gregg | 40/124.1 |
| 5,259,133 | 11/1993 | Burtch . | |
| 5,287,641 | 2/1994 | Showers . | |

FOREIGN PATENT DOCUMENTS

| | | | |
|---|---|---|---|
| 162551 | 5/1921 | United Kingdom | 40/124.1 |
| 881755 | 11/1961 | United Kingdom . | |

*Primary Examiner*—Kenneth J. Dorner
*Assistant Examiner*—James O. Hansen
*Attorney, Agent, or Firm*—Larson and Taylor

[57] ABSTRACT

A display device is provided which comprises a support portion and an integral display portion constructed in such a manner that the portions are relatively movable, through a periscoping action of the display portion, between a planar configuration of the device wherein the display portion is substantially covered by the support portion so as to form a card-like construction, and a erected configuration of the device wherein the display portion extends upwardly from a support formed by the support portion. The display portion comprises a display panel including a tongue which in the erected configuration extends through a central slot in the display portion and a base including shoulders disposed on opposite sides of the tongue. The support portion includes first and second pairs of serially arranged panels which, in the planar configuration, are disposed so as to lie flat and to overlie respective faces of the display panel and which, in said erected configuration, are arranged at an angle to form the support for the display panel. An end panel of the support portion is secured to the base portion of the display portion. A blank for making the device is also provided.

20 Claims, 2 Drawing Sheets

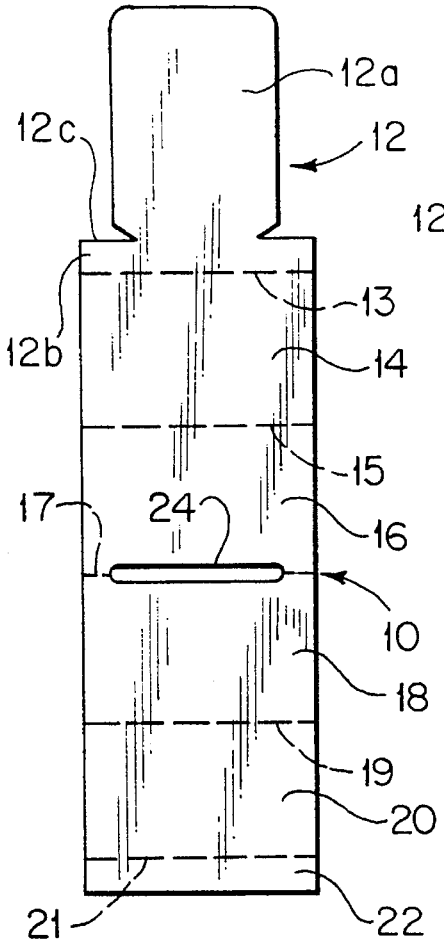
FIG. 1
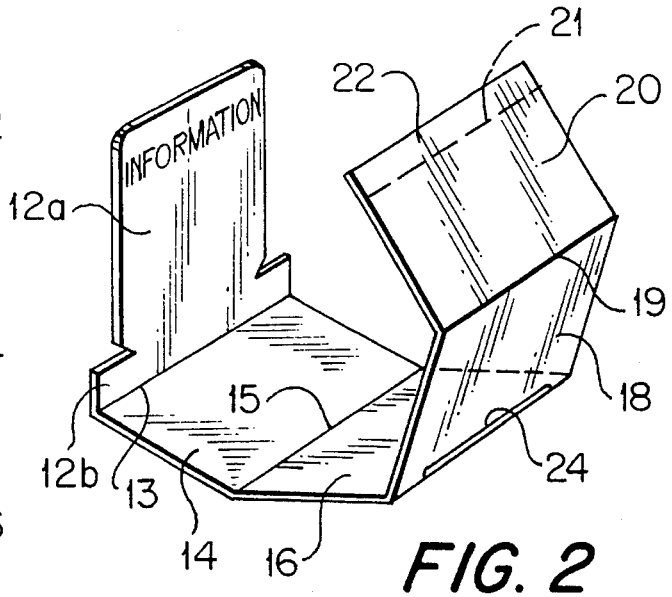
FIG. 2
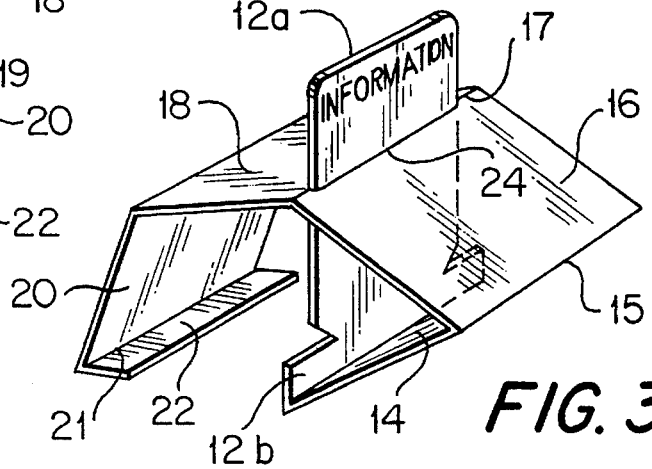
FIG. 3
FIG. 4
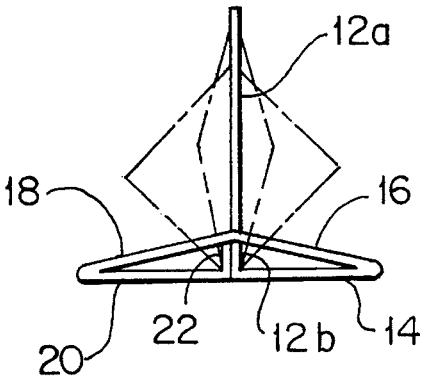
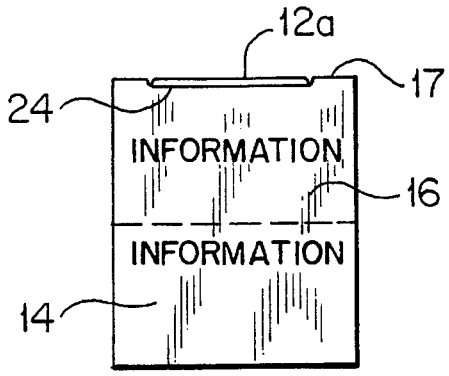
FIG. 5

ERECTABLE PERISCOPING DISPLAY DEVICE

FIELD OF THE INVENTION

The present invention relates to novelty items used, e.g., for promotional purposes and/or as items to be collected in sets and, more particularly, to an erectable display device which provides for a periscoping action of a display portion or panel in erecting of the device from a planar configuration.

BACKGROUND OF THE INVENTION

Although the invention is clearly not limited to such an application, one application thereof is in connection with an erectable baseball card. In an earlier patent, U.S. Pat. No. 5,259,133 (Burtch), in which one of the co-inventors here is the patentee, there is described a "pop-up" display device which includes an erectable pop-up display portion that is erectable from a planar configuration, in which the device resembles a baseball card or the like, to a display configuration or state wherein an action figure such as a baseball player "pops up" from the baseball "card" and is displayed. As explained in that patent, baseball cards are very popular in the United States and throughout the world, particularly with younger fans, and many of these fans also collect similar cards involving sports such as football, basketball, hockey and the like. Such sports cards are typically flat, i.e., two dimensional, cards containing a photograph of a particular player together with identifying information on one side and further information, such as the birth date, home town, team or teams played with, and playing records of the player, on the other side. The "pop-up" display device of this earlier patent provides added interest as compared with conventional cards because of the pop-up feature.

As indicated above and explained in more detail below, the present invention generally relates to a display device which provides a periscoping action in the transformation thereof from a flat configuration to an erected, display configuration wherein a display portion or panel is supported by an erectable base. Patents of interest with respect to display structures including related base constructions include the following: U.S. Pat. Nos. 2,142,826 (Rosello); 3,226,863 (Southard); 2,449,911 (Roth); 2,311,218 (Fandrich); 2,530,950 (Ebert et al); 3,092,051 (Nichols); and 2,720,046 (Decker). In general, these patents disclose display structures including a base in the form of an isosceles triangle in end view and including central upright support elements (e.g., the Rosello and Nichols patents), and/or which define a slot or opening (e.g., the Roth, Decker and Fandrich patents), adapted to support an advertising display member, e.g., a display card or the like (or in the case of the Nichols patent, a calendar pad). In the display device of the Ebert et. al. patent, an upright element defines a "poster" while in the Southard patent an easel-type support is provided which includes an extendable and retractable "tab." A further patent of general interest is U.S. Pat. No. 5,287,641 (Showers) which relates to a collectible card device including a sliding insert.

SUMMARY OF THE INVENTION

In accordance with the invention, a display device is provided which is convertible through a periscoping action generally between a flat or planar configuration wherein the device is in the nature of a card and can, for example, include the "information" (player photograph, statistics and so on) found on a baseball card, and an erected configuration wherein a display member or panel is supported by a base structure formed by the remainder of the card.

In accordance with a preferred embodiment of the invention, a display device is provided which comprises a support portion and an integral display portion adjoined to the support portion, the display and support portions being relatively movable between a first, planar configuration wherein the display portion is substantially covered by the support portion, and a second, erected configuration wherein the display portion extends upwardly from a base formed by the support portion, the support portion including first and second pairs of serially arranged panels defined by fold lines and formed integrally with the display portion so that, in said planar configuration, the pairs of panels lie flat and overlie respective faces of the display portion and so that, in said erected configuration, the pairs of panels are disposed at an angle to form the base for the display portion, adjacent panels of the pairs of panels being joined along a central fold line having a central opening therein through which the display portion periscopes during the relative movement of the display and support portions from said first configuration to said second configuration.

Preferably, the display portion comprises a display panel including a tongue portion and a base portion including shoulders disposed on opposite sides of the tongue portion.

Advantageously, the support portion includes an end panel joined to one panel of said pairs of panels along a further fold line and secured to the base portion of the display panel.

In one preferred embodiment, at least one panel of the pairs of panels includes a projecting wing portion disposed between spaced parts of a respective fold line between the at least one panel and an adjacent panel of the corresponding pair of panels, the wing portion extending laterally from the base in the erected configuration of the device. The adjacent panel preferably includes a slot in an edge thereof adjacent to the wing portion. In an advantageous implementation of this embodiment, one panel of each of the pairs of panels includes such a projecting wing portion, so that, in the erected configuration of the device, wing portions extend laterally from the base in opposite directions.

Advantageously, the width of the opening through which the display portion periscopes is such that a tip of the display portion is exposed, for gripping purposes, in the planar configuration of the device. This opening can take different forms and in one embodiment, the opening comprises a single slot, while in another embodiment, the opening comprises a pair of slots interconnected by a slit.

In accordance with a further aspect of the invention, a blank for a display device is provided, the blank comprising a display panel comprising a tongue portion and a base portion extending outwardly on both sides of the tongue portion to form shoulders, and first, second, third, fourth and fifth further panels formed integrally with said display panel and arranged in serial relation, said further panels being defined by respective fold lines between adjacent panels, the first panel being disposed adjacent the display panel and being separated therefrom by a further fold line, the second and third panels including a common opening therein formed along a fold line between the second and third panels and disposed centrally of the fold line between those third and fourth panels.

In one preferred embodiment, at least one of the first and fourth panels includes a precut wing portion formed between spaced portions of a discontinuous fold line between the at least one panel and an adjacent panel, the wing portion projecting beyond the discontinuous fold line towards the common opening. The adjacent panel preferably includes a notch therein disposed centrally with respect to the wing portion. In an advantageous implementation of this embodiment, both of said first and fourth panels include such wing portions. In this implementation, the second and third panels preferably include a notch therein in an edge thereof adjacent to the respective wing portion.

Other features and advantages of the invention will be set forth in, or apparent from, the following detailed description of preferred embodiments of the invention.

BRIEF DESCRIPTION OF THE DRAWINGS

FIG. 1 is a plan view of a blank constructed in accordance with a first, preferred embodiment of the invention;

FIG. 2 and 3 are perspective views showing two steps in the assembly of the display device of this embodiment from the blank of FIG. 1;

FIG. 4 is an end elevational view showing the assembled device in the erected configuration, with intermediate configurations being shown in dashed lines;

FIG. 5 is a plan view of the assembled device in the flat or planar configuration;

DESCRIPTION OF THE PREFERRED EMBODIMENTS

Figure 6:
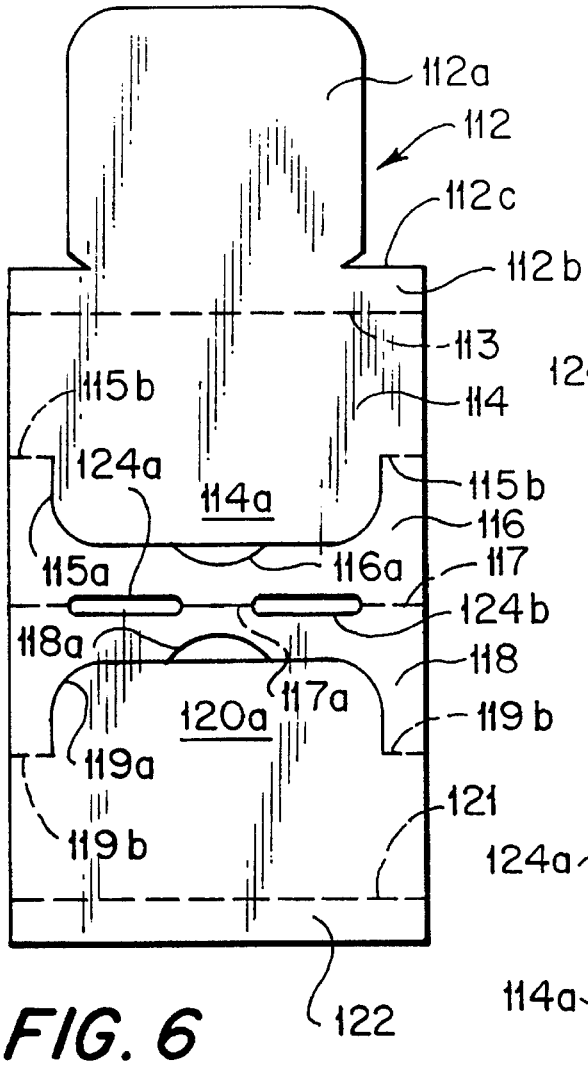
FIG. 6 is a plan view of a blank constructed in accordance with a further preferred embodiment of the invention.

Referring to FIGS. 1 to 5, a first preferred embodiment of the display device of the invention is shown. FIG. 1 illustrates the blank 10 from which the display device is made and, as shown, blank 10 includes a display portion or panel 12 including an elongate tongue portion 12*a*, which is more narrow in width than the remainder of the blank 10, and a base portion 12*b* which extends the full width of the blank 10 so as to form shoulders 12*c* on opposite sides of tongue portion 12*a*. A series of five rectangular panels 14, 16, 18, 20 and 22 are formed or defined by respective fold lines 13, 15, 17, 19 and 21, as illustrated. A slot or elongate opening 24 is formed centrally along fold line 17 between panels 16 and 18 and is a width to permit tongue portion 12*a* to be inserted therethrough.

Referring to FIGS. 2 and 3, two steps in the assembly from blank 10 of the display device of this embodiment are shown. As illustrated, the blank 10 is folded along the various fold lines referred to above and the end opposite to tongue portion 12*a*, i.e., that formed by panel 22, is brought toward and over tongue portion 12*a* so that tongue portion 12*a* can be inserted through slot 24. End panel 22 is then brought into registration with the base portion 12*b* of display panel 12, and adhered thereto, as shown in FIG. 4, such as by gluing.

Referring to FIGS. 4 and 5, the assembled display device shown in the two operative or end configurations thereof. Although it will be appreciated that the designation of one configuration as the first configuration is arbitrary, in the first or closed configuration shown in FIG. 5, the display device assumes a flat or planar configuration so as to resemble a flat card or the like. In this configuration the display panel 12 including tongue portion 12*a* is substantially completely covered by the remainder of the device and, in particular, the information carrying side or surface of tongue portion 12*a* is covered by panels 14 and 16. As shown, the tip of tongue portion 12*a* extends out of slot 24 above panel 16 and thus enables tongue portion 12*a* to be gripped by the fingers.

Turning now to the second, display configuration, by holding on to the exposed tip of tongue portion 12*a* and pushing panels 14 and 16 and opposed panels 18 and 20 downwardly as indicated in dashed lines in FIG. 4, the panels are brought into the position or configuration shown in solid lines in FIG. 4. In this configuration, adjoining edges of panels 16 and 18 rest at fold line 17 on the base formed by shoulders 12*c* of base portion 12*b* of panel 12 and by the panel 22 secured to base portion 12*b*. This base thus serves as an end stop for the movement of the panels. It will be appreciated that display panel 12 performs what can be termed a periscoping movement up through slot 24 until tongue portion 12*a* is fully exposed. It will be appreciated that in this position, i.e., in the erected configuration of FIG. 4, panels 14, 16 and 18, 20 form a stand or support base for display panel 12.

It will be understood that the names "display" portion and "support" portion are not meant to exclusively define the functions of the two portions 10 and 12 and that, for example, the support portion also serves as a display function. As shown in FIG. 5, the panels 14 and 16 can both contain "information" which is visible, i.e., is displayed, in the planar configuration of the device, and that the "information" displayed by panel 16 is also visible in the erected configuration of FIG. 4. It will also be understood where the device is used, for example, as a give-away item to promote a product, that this "information" can take the form of a product name, advertising copy, pictures or photographs of the product (or of the product in use) and so on. Of course, the display device can be used in many other ways, including, for example, as an erectable sports card (e.g., a baseball card) wherein a player would be depicted and relevant statistics set out on the card. The tongue portion 12*a* could include an action photographs of a player and could be cut out or shaped so as to, e.g., follow the outline of the player as depicted in action.

Referring to FIGS. 6 to 9, a second preferred embodiment of the invention is illustrated. FIG. 6 illustrates the blank used in this embodiment and because the basic overall blank is similar to that of FIG. 1 corresponding elements have been given the same reference numerals preceded by a 37 1" so that, e.g., the blank is designated 110 and the display panel is designated 112. The chief difference between the two embodiments that additional precut portions are provided in the blank 110 of FIG. 6. Specifically, the simple fold lines 15 between panels 14 and 16 of the embodiment of FIG. 1 are replaced in FIG. 6 with a central cut line portion 115*a* with fold lines 115*b* on opposite sides thereof. The cut line portion 115*a* forms a shaped projecting tab or wing 114*a* which extends or projects from panel 114 into what would be panel 16 in the embodiment of FIG. 1. Further, a gripping notch or recess 116*a* is provided in panel 116 adjacent the center of tongue 114*a*. Similarly, panel 120 includes a wing portion 120*a* formed by a precut line 119*a* and adjacent panel 118 includes a gripping notch 118*a*, as illustrated.

In addition, in the embodiment of FIG. 6, in place of slot 24 of FIG. 1, two gripping slots 124*a* and 124*b* are formed along fold line 117 and the fold line is cut at a section thereof between slots 124*a* and 124*b* to form a slit denoted 117*a*.

The method of assembly of the display device of the embodiment of FIGS. 6 to 9 is essentially the same as discussed above wherein tongue 112*a* is inserted through the opening provided by slots 124*a* and 124*b* and connecting slit 117*a*, and the end panel 122 is secured, e.g., by an adhesive provided thereon or by gluing, to the base portion 112*b* of panel 112.

Figure 8:
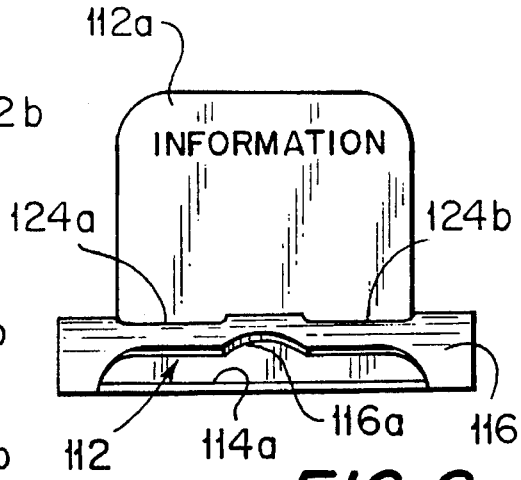
FIG. 8 side elevational view of the assembled display device of FIG. 7.
Figure 9:
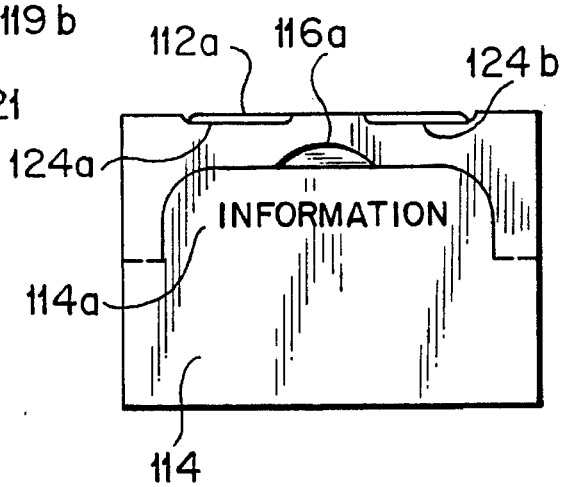
FIG. 9 is a plan view of the device of FIGS. 7 and 8, in the planar configuration thereof.
Figure 7:
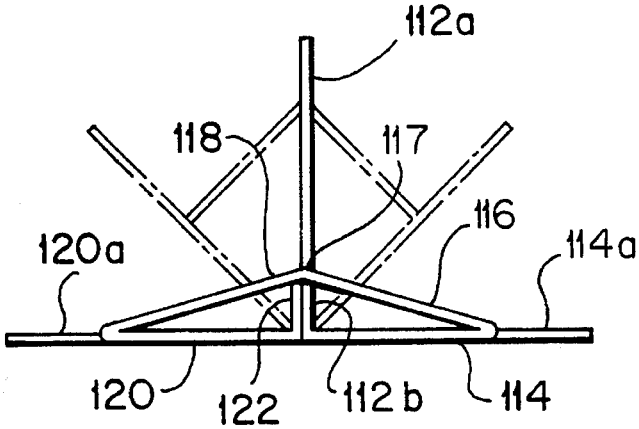
FIG. 7 an end elevational view of the assembled display device of this embodiment in the erected configuration thereof, with an intermediate configuration shown in dashed lines.

The final product is illustrated in its erected configuration in FIGS. 7 and 8 and, as indicated, the salient feature of this embodiment is that tabs or wings 114*a* or 120*a* separate from panels 116 and 118 and extend outwardly on opposite sides of the display device in plane of panels 114 and 120 so as to rest on the support surface for the device. This arrangement provides an additional exposed flat areas, viz., the upper facing surfaces of tabs 114*a* and 120*a*, on which to provide information of various kinds. The device can, of course, be made to assume the planar configuration shown in FIG. 9 by a "down periscope" action produced by relative movement of the display and support portions, wherein tongue portion 112*a* is drawn down into the opening provided by slots 124*a* and 124*b* and slit 117*a*.

Of course, the applications and variations discussed above relative to FIGS. 1 to 5 also apply to the embodiment of FIGS. 6 to 9. It will be appreciated that the additional exposed areas provided by laterally extending tabs or wings 114*a* and 120*a* provide additional interest as well as additional information space.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A display device comprising a support portion and an integral display portion adjoined to said support portion, said display and support portions being relatively movable between a first, planar configuration wherein said display portion is substantially covered by said support portion, and a second, erected configuration wherein said display portion extends upwardly from a base formed by said support portion, said support portion including first and second pairs of serially arranged panels defined by fold lines and formed integrally with said display portion so that in said planar configuration said pairs of panels lie flat and overlie respective faces of said display portion and so that in said erected configuration said pairs of panels are disposed at an angle to form said base for said display portion, adjacent panels of said pairs of panels being joined along a central fold line having a central opening therein through which said display portion periscopes during said relative movement of said display and support portions from said first configuration to said second configuration, at least one panel of said pairs of panels including a projecting wing portion disposed between spaced parts of a respective fold line between the at least one panel and an adjacent panel of the corresponding pair of panels, said wing portion extending laterally from said base in the erected configuration of said device.

2. A display device as claimed in claim 1 wherein said display portion comprises a display panel including a tongue portion and a base portion including shoulders disposed on opposite sides of said tongue portion.

3. A display device as claimed in claim 2, wherein said support portion includes an end panel joined to one panel of said pairs of panels along a further fold line and secured to said base portion of said display panel.

4. A display device as claimed in claim 1 wherein said adjacent panel includes a slot in an edge thereof adjacent to said wing portion.

5. A display device as claimed in claim 1, wherein one panel of each of said pairs of panels includes a said projecting wing portion, so that, in the erected configuration of the device, wing portions extend laterally from said base in opposite directions.

6. A display device as claimed in claim 1, wherein the width of said opening is such that a tip of said display portion is exposed, for gripping purposes, in said planar configuration of the device.

7. A display device as claimed in claim 1 wherein said opening comprises at least one slot.

8. A display device as claimed in claim 1 wherein said opening comprises a pair of slots interconnected by a slit.

9. A display device as claimed in claim 1 wherein said opening comprises at least one slot and at least one slit of narrower width than said slot.

10. A blank for a display device, said blank comprising a display panel comprising a tongue portion and a base portion extending outwardly on both sides of said tongue portion to form shoulders, and first, second, third, fourth and fifth further panels formed integrally with said display panel and arranged in serial relation, said further panels being defined by respective fold lines between adjacent panels, said first panel being disposed adjacent said display panel and being separated therefrom by a further fold line, said second and third panels including a common opening therein formed along a fold line between said second and third panels and disposed centrally of said fold line between said second and third panels, at least one of said first and fourth panels including a precut wing portion formed between spaced portions of a discontinuous fold line between said one panel and an adjacent panel, said wing portion projecting beyond said discontinuous fold line towards said common opening.

11. A blank as claimed in claim 10 wherein said adjacent panel includes a notch therein disposed centrally with respect to said wing portion.

12. A blank as claimed in claim 11 wherein both of said first and fourth panels include a said wing portion.

13. A blank as claimed in claim 12, wherein said second and third panels include a notch therein in an edge adjacent to the respective wing portion.

14. A blank as claimed in claim 10 wherein said common opening includes a pair of spaced slots joined together by an intervening slit.

15. A blank for a display device as claimed in claim 10 wherein said common opening comprises at least one slot and at least one slit of narrower width than said slot.

16. A display device comprising a support portion and an integral display portion adjoined to said support portion in such a manner that the portions are relatively movable between a first, planar configuration of the device wherein said display portion is substantially covered by said support portion, and a second, erected configuration of the device wherein said display portion extends upwardly from a base formed by said support portion, said display portion comprising a display panel including a tongue portion and a base portion including shoulders disposed on opposite sides of said tongue portion, said support portion comprising first and second pairs of serially arranged panels which, in said planar configuration, are disposed so as to lie flat and to overlie respective faces of said display panel and which, in said erected configuration, are arranged at an angle to form said base for said display panel, the panels of said pairs of panels being respectively joined along first and second fold lines, one panel of one of said pairs of panels being joined to said display panel along a third fold line, and adjacent panels of said pairs of panels being joined together along a fourth fold line, said support portion including an opening formed along said fourth fold line centrally thereof through which said display panel periscopes during said relative movement of said display and support portions from said first configuration to said second configuration, said support portion further including an end panel joined to one panel of the other of said pairs of panels along a fifth fold line and secured to said base portion of said display panel in registration with said base portion, said end panel and said base portion being of the same axial width so that said end panel and said base portion secured thereto form common shoulders against which said fourth fold line abuts in said erected configuration and said one panel of said one pair of panels and said one panel of said other pair of panels lie flat on a supporting surface in said erected configuration, said opening comprising at least one slot and at least one slit of narrower width than said slot.

17. A display device as claimed in claim 16 wherein at least one panel of said pairs of panels includes a projecting wing portion disposed between spaced parts of a respective fold line between the at least one panel and an adjacent panel of the corresponding pair of panels, said wing portion extending laterally from said base in the erected configuration of said device.

18. A display device as claimed in claim 17 wherein said adjacent panel includes a notch in an edge thereof adjacent to said wing portion.

19. A display device as claimed in claim 17, wherein one panel of each of said pairs of panels includes a said projecting wing portion, so that, in the erected configuration of said, wing portions extend laterally from said base in opposite directions.

20. A display device as claimed in claim 16 wherein said opening comprises at least one slot and the width of said slot is such that a tip of the tongue portion of said display panel is exposed in said planar configuration of the device.

* * * * *